US007052258B2

(12) United States Patent
Amano et al.

(10) Patent No.: US 7,052,258 B2
(45) Date of Patent: May 30, 2006

(54) TROCHOIDAL PUMP

(75) Inventors: Masaru Amano, Kiryu (JP); Kenichi Fujiki, Kiryu (JP); Yasunori Ono, Kiryu (JP)

(73) Assignee: Yamada Manufacturing Co., Ltd., Kiryu (JP)

( * ) Notice: Subject to any disclaimer, the term of this patent is extended or adjusted under 35 U.S.C. 154(b) by 127 days.

(21) Appl. No.: 10/616,509

(22) Filed: Jul. 10, 2003

(65) Prior Publication Data

US 2004/0057860 A1 Mar. 25, 2004

(30) Foreign Application Priority Data

Jul. 11, 2002 (JP) ..... 2002-203264
Jun. 19, 2003 (JP) ..... 2003-174279

(51) Int. Cl.
*F04C 18/00* (2006.01)
*F04C 2/10* (2006.01)

(52) U.S. Cl. ..... 418/171; 418/109; 418/190

(58) Field of Classification Search ..... 418/166, 418/171, 109, 190
See application file for complete search history.

(56) References Cited

U.S. PATENT DOCUMENTS 4,976,595 A * 12/1990 Taniguchi ..... 418/171
5,554,020 A * 9/1996 Rao et al. ..... 418/178

FOREIGN PATENT DOCUMENTS

| | | | |
|---|---|---|---|
| AU | 20406 A | * | 5/1929 |
| EP | 99950 A | * | 2/1984 |
| JP | 61210282 A | * | 9/1966 |
| JP | 64-56589 | | 4/1989 |
| JP | 2-95787 | | 4/1990 |
| JP | 02095788 A | * | 4/1990 |

* cited by examiner

*Primary Examiner*—Theresa Trieu
(74) *Attorney, Agent, or Firm*—McGinn IP Law Group, PLLC

(57) ABSTRACT

To reduce noise caused by pulsation generated when fluid is expelled, in a trochoidal pump comprising an inner rotor and outer rotor having trochoidal toothed shapes.

[Means of Solution] The inner rotor 5 and outer rotor 6 having trochoidal toothed shapes are set in such a manner that when they are in a mutually intermeshing state, a tip clearance $d_0$ is created between the respective tooth crests 5*a* of the inner rotor 5 and the outer rotor 6. In at least one position of this group of tip clearances $d_0$, a large clearance $d_1$ forming a large interval is provided.

20 Claims, 10 Drawing Sheets

TROCHOIDAL PUMP

BACKGROUND OF THE INVENTION

1. Field of the Invention

The present invention relates to a trochoidal pump comprising an inner rotor and an outer rotor having a trochoidal toothed shape, wherein noise caused by pulsation generated when a fluid is discharged can be reduced.

2. Description of the Related Art

A trochoidal pump is widely used as a lubricating oil pump fitted in an automobile engine, or the like. This trochoidal pump is fitted with an inner rotor and an outer rotor having a trochoidal toothed shape. Utility Model No. (Sho)64-56589 discloses a trochoidal pump of this kind, having a composition wherein the rear side face of each tooth of the inner rotor in the direction of rotation is formed into a simple arc about a single central point, and the height of this section is made lower than the tooth shape based on the trochoidal curve.

Furthermore, Japanese Patent Laid-open No. (Hei)2-95787 discloses a pump wherein the faces of the tips of the inner teeth of the outer rotor and the outer teeth of the inner rotor are formed so as to follow a partial circumference of a circular cylinder drawn about the centre of rotation of the respective rotor, the interval between the front ends of the teeth of the inner rotor and the outer rotor, in other words, the tip clearance, which has an effect on the sealing properties, being maintained at a prescribed value, whilst the front faces of the rotor teeth are adjusted. The two foregoing patents specify the shape of the teeth in such a manner that a prescribed tip clearance is set, equally for each of the teeth.

The foregoing disclosures propose devices wherein the shape of the teeth is changed in order to set a prescribed tip clearance equally for each of the teeth, thereby reducing the pulsation of the fluid, reducing the noise, and also increasing the pump performance. Although the noise is certainly restricted by reduction of fluid pulsation, in reducing the pulsation, the state where the fluid is enclosed in the spaces between the inner rotor and outer rotor is eliminated, and furthermore, it becomes necessary to provide a tip clearance between the ends of the teeth of the inner rotor and the outer rotor, in such a manner that the fluid can be introduced into the spaces and expelled therefrom, smoothly and readily.

By setting this tip clearance to a suitable value, it is possible to reduce pulsation and hence to reduce noise. However, increasing the tip clearance simultaneously produces a drawback in that pump performance declines. Moreover, if the tip clearance is set to a small value in order to maintain pump performance, it then becomes difficult to reduce pulsation and noise. It is extremely hard to set up optimum conditions whilst resolving these mutually contradictory conditions.

The prior art technology sets the same prescribed tip clearance equally for each of the respective teeth, and therefore the setting of the tip clearance is important, but since this tip clearance is set uniformly at the respective teeth of the inner rotor and outer rotor when the pump rotates, a systematic pulsation is generated by the uniformly established tip clearances. When the pressurized fluid generating this systematic pulsation is discharged from the pump, resonance is liable to occur in both the pump and the fluid supply device, and it becomes difficult to prevent the generation of noise. The object of the present invention lies in reducing pulsation of this kind whilst at the same time maintaining pump efficiency at a uniform level.

SUMMARY OF THE INVENTION

Therefore, as a result of thorough study and research with the aim of resolving these problems, the present inventors devised the present invention concerning a trochoidal pump wherein an inner rotor 5 and an outer rotor 6 having trochoidal toothed shapes are provided in a mutually intermeshing state, in such a manner that a tip clearance is created between each tooth crest of the inner rotor 5 and the outer rotor 6, a large clearance forming a large interval being provided in at least one location of the group of said tip clearances, whereby pulsation during expulsion of fluid can be reduced markedly by means of an extremely simple structure, and hence the aforementioned problems are resolved.

DESCRIPTION OF THE PREFERRED EMBODIMENTS

Figure 1:
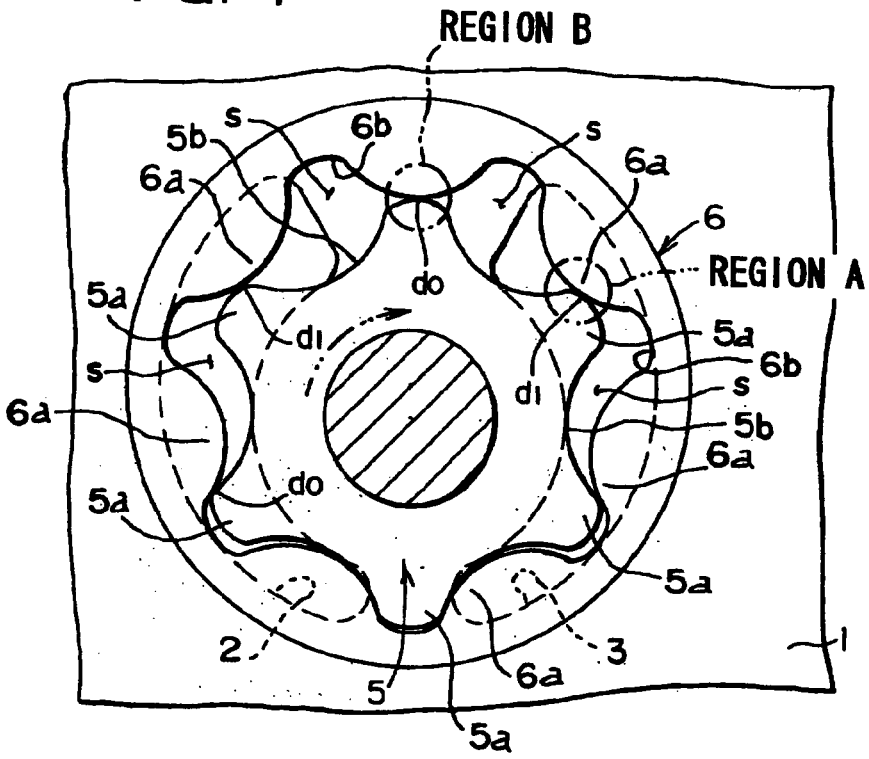
FIG. 1 is a front view of the present invention.

Below, embodiments of the present invention are described with reference to the drawings. As shown in FIG.

1, the trochoidal pump according to the present invention comprises an inner rotor 5 and an outer rotor 6 having a trochoidal toothed shape installed in a rotor chamber 1 formed inside a casing, similarly to a general trochoidal pump. The rotor chamber 1 is formed with an intake port 2 and an outlet port 3 extending in the circumferential direction in the vicinity of the outer circumference. The intake port 2 and the outlet port 3 are formed in laterally symmetrical positions about the centre of the rotor chamber 1.

The inner rotor 5 has a number of teeth one fewer than the outer rotor 6, and a relationship is formed whereby each time the inner rotor 5 performs one whole revolution, the outer rotor 6 rotates with a delay equivalent to one tooth behind the inner rotor. In this way, the inner rotor 5 comprises tooth crests 5*a* which project in an outward direction and concave shaped tooth valleys 5*b*, and similarly, the outer rotor 6 comprises tooth crests 6*a* which project towards the centre from the inner circumference thereof, and concave shaped tooth valleys 6*b*. The inner rotor 5 and outer rotor 6 always intermesh at one point, tooth crests 5*a* of the inner rotor 5 being introduced into tooth valleys 6*b* of the outer rotor 6 and tooth crests 6*a* of the outer rotor 6 being introduced into tooth valleys 5*b* of the inner rotor 5.

As shown in FIG. 1, a plurality of demarcated spaces s, s, . . . are formed between the inner rotor 5 and the outer rotor 6 when they are operated, and by means of the rotating inner rotor 5 and outer rotor 6, fluid is taken in via the intake port 2 whilst the spaces on the input port 2 side gradually increase in volume, and furthermore, fluid is expelled from the outlet port 3 whilst the spaces s on the outlet port 3 side gradually decrease in volume.

Figure 2:
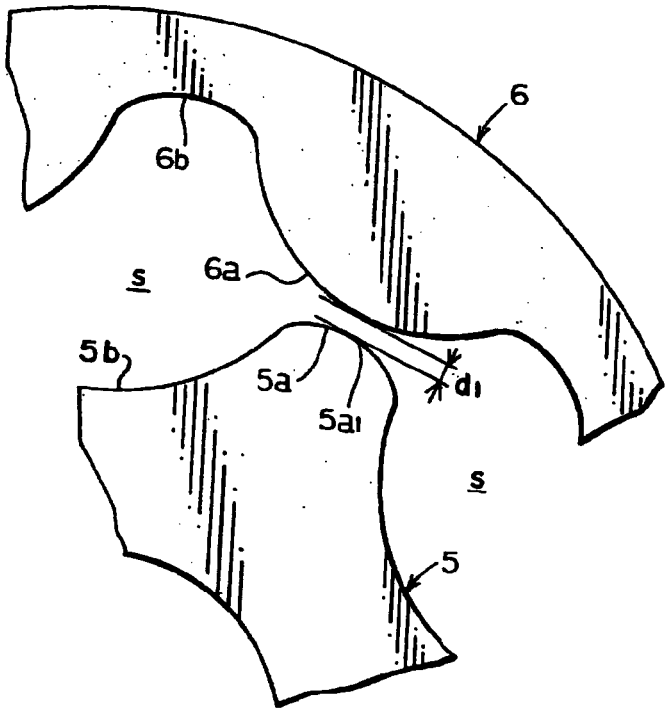
FIG. 2 is an enlarged view of section (A) in FIG. 1.
Figure 3:
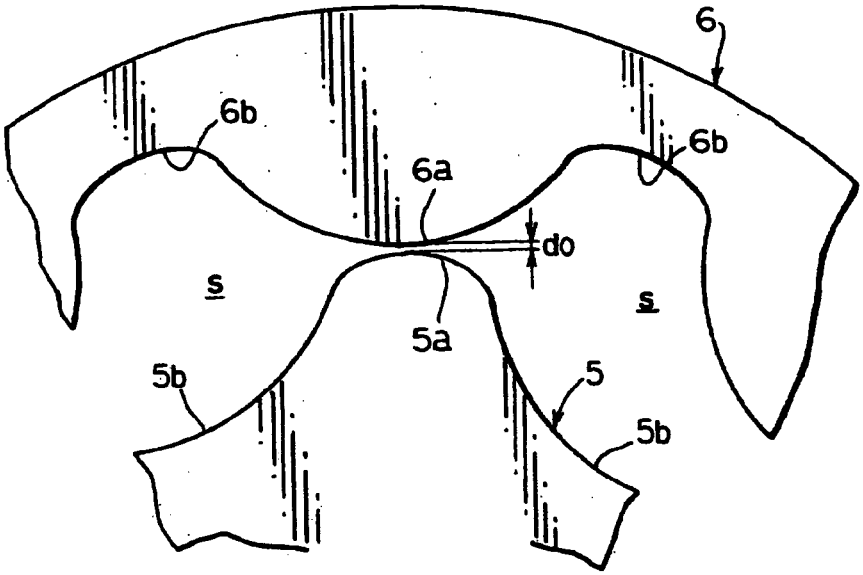
FIG. 3 is an enlarged view of section (B) in FIG. 1.
Figure 4:
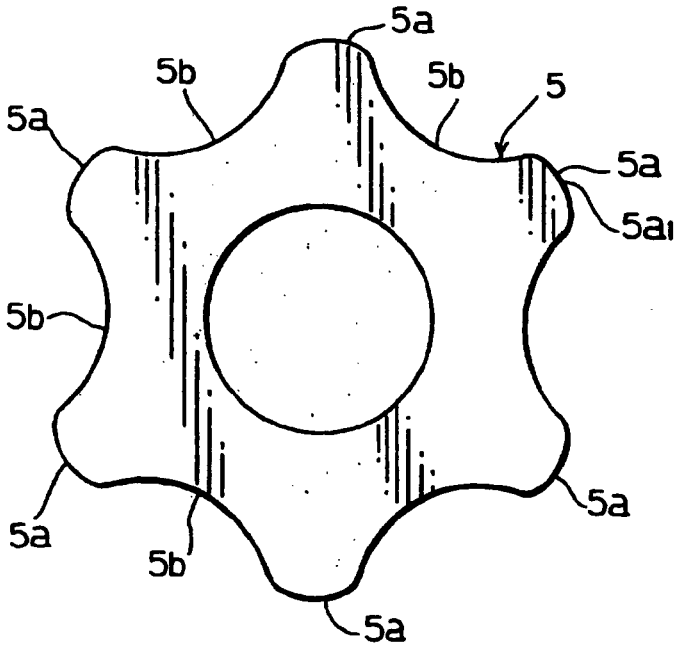
FIG. 4 is a front view of an inner rotor having an even number of teeth according to the present invention.
Figure 5:
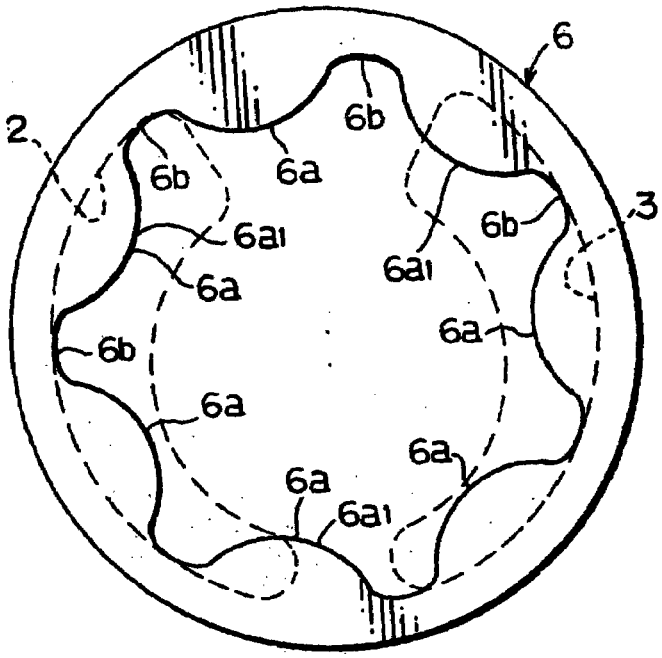
FIG. 5 is a front view of an outer rotor corresponding to the inner rotor in FIG. 4.
Figure 6:
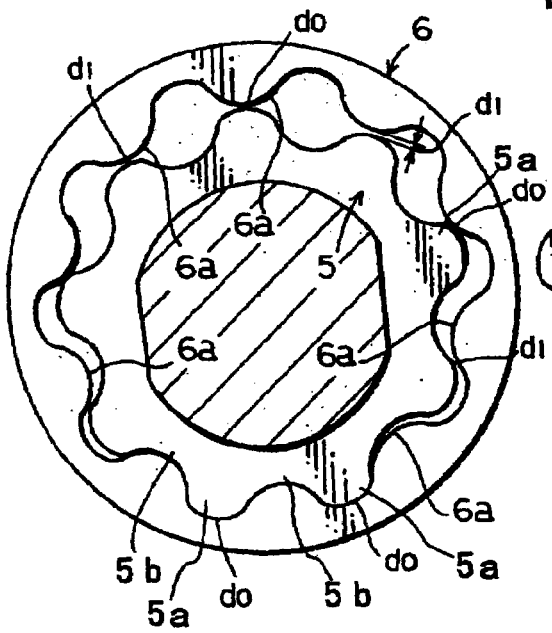
FIG. 6(A) is a front view showing a combined state of an inner rotor having an odd number of teeth and an outer rotor corresponding to this inner rotor and FIG. 6(B) is a front view of an inner rotor having an odd number of teeth.
Figure 6:
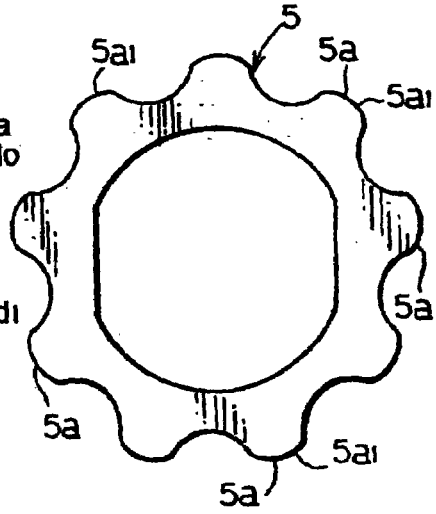

In the trochoidal pump described above, in the shape of the teeth where the inner rotor 5 and outer rotor 6 intermesh, a clearance which is greater than the normally set tip clearance $d_0$, in other words, a large clearance $d_1$, is set as illustrated in FIG. 1 and FIG. 2. The tooth crests for achieving this large clearance $d_1$ are formed on either the outer rotor 6 or the inner rotor 5. In setting a large clearance $d_1$ of this kind, as shown in FIG. 4, a large clearance tip $\mathbf{5}a_1$ is formed on a suitable one or plurality of the crest ends of the plurality of tooth crests 5*a* of the inner rotor 5. Alternatively, as shown in FIG. 5, a large clearance tip $\mathbf{6}a_1$ is formed on a suitable one or plurality of the crest ends of the plurality of tooth crests 6*a* of the outer rotor 6. The tooth shape of the large clearance tips $\mathbf{5}a_1$, $\mathbf{6}a_1$ is achieved by processing for removing the front end of the tooth crest, or forming a tooth shape having a low front end on the tooth crest when forming the rotor, or the like.

The generally established tip clearance $d_0$ is set uniformly, and by providing a tooth crest set especially to a large clearance $d_1$ in the rotor teeth, the tip clearance $d_0$ of the intermeshing rotors becomes non-uniform. For example, if the tooth crests are set in such a manner that a large clearance $d_1$ is provided in two places on an inner rotor 5 having four teeth, then the large clearance is provided every other tooth and there will be tooth crests having the normally established tip clearance of $d_0$ between these tooth crests. Moreover, if tooth crests having a large clearance $d_1$ are provided in two places in an inner rotor having six teeth, then they will be provided at intervals of three teeth, or an intervals of two teeth and fourth teeth.

If the inner rotor 5 has a number of teeth greater than 6, then the tooth crests set to have a large tip clearance $d_0$ are set at least every other tooth position, and hence there will be tooth crests having a large tip clearance $d_0$ set every other tooth position, or at intervals of one teeth and three teeth, as described previously, depending on the number of such teeth set. This applies similarly in cases where the outer rotor 6 has six or more teeth. A tooth crest having a large clearance $d_1$ should be set in at least one position, but desirably a suitable number of such tooth crests are provided, according to the number of teeth on the rotors. Setting a large clearance $d_1$ on a rotor having six teeth or more is desirable, since it allows pulsation to be suppressed without reducing volume efficiency.

Tooth crests having an enlarged clearance $d_1$ make it possible to reduce the number of enclosed space volumes by interconnecting the spatial volumes formed between the intermeshing rotors, thus reducing pulsation, and hence pulsation can be suppressed to a low value. Furthermore, any reduction in volume efficiency caused by interconnection of the spatial volume between the rotors can be restricted by designing the rotors to have six or more teeth. In other words, adjacent spaces s, s are interconnected by means of the large clearance $d_1$, thereby permitting the passage of fluid and preventing enclosure of the fluid.

Next, if the inner rotor 5 or outer rotor 6 has an even number of teeth, then of the number of rotor teeth n, a number of tooth crests equal to n/2 are set to have a large clearance $d_1$. The tooth crests formed with a large clearance $d_1$ are set at the least every other tooth. If the number of teeth n is even, then by setting the number of tooth crests formed with a large clearance $d_1$ to n/2, it is possible to a well balanced arrangement, and pulsation can be suppressed whilst maintaining volume efficiency.

Furthermore, if the inner rotor 5 or outer rotor 6 has an odd number of teeth, then of the number of rotor teeth n, a number of tooth crests (n−1)/2 are set to have a large clearance $d_1$, these being disposed at the least every other tooth, similarly to the foregoing description. In the case of an odd number of teeth, the ratio of the number of tooth crests having a standard tip clearance $d_0$ is set to a larger ratio, and furthermore, the tooth crests formed with a large clearance $d_1$ are not arranged equidistantly. Since the sequence of the tip clearance $d_0$ and the large clearance $d_1$ will be non-regular and non-uniform, and the positioning of the tooth crests having a large clearance $d_1$ will also be non-uniform, the regularity of the hydraulic pulsation will be disturbed, thus disrupting the resonance, and hence pulsation can be suppressed and volume efficiency can be maintained.

Thereby, the tip clearance $d_0$ of the rotors ceases to be uniform, and assumes a non-uniform state. The large clearance $d_1$ moves in accordance with the meshing rotation of the outer rotor 6 and inner rotor 5, thereby changing phase. If the number of large clearances $d_1$ is more than one, then the positioning thereof may be uniform or non-uniform with respect to the number of rotor teeth, or it may be non-uniform, regardless of the number of rotor teeth.

By selecting the arrangement thereof suitably, the regularity of the hydraulic pulsation of the pump is disturbed, thus making it possible to prevent resonance due to pulsation and to reduce noise. This is now described on the basis of a graph illustrating this effect. Firstly, the value of the hydraulic pulsation plotted on the Y axis is as shown in the graph, the units being decibels (dB). The graph relates to a rotational speed of 2000 rpm. The waveform of the graph is achieved by measuring the frequency of the hydraulic pulsation (the resonance speed).

The standard value graph shows data for a normal trochoidal type oil pump. The frequency of the hydraulic pulsations in this graph is determined by the rotational speed of the pump and the number of teeth of the rotors. In this graph specifically, the pump speed is 2000 rpm, the number of teeth n of the inner rotor 5 is 6 and the number of teeth n of the outer rotor 6 is 7, and the graph shows the frequency generated by these rotors. For example, graphs are illustrated for a pump having a standard tip clearance $d_0$ (standard value) (see FIG. 10), a pump wherein the large clearance $d_1$ is set in two places (on two teeth) (see FIG. 8), and a pump wherein the large clearance $d_1$ is set in three places (three teeth) (see FIG. 9), each graph depicting the corresponding state of the hydraulic pulsation.

Figure 10:
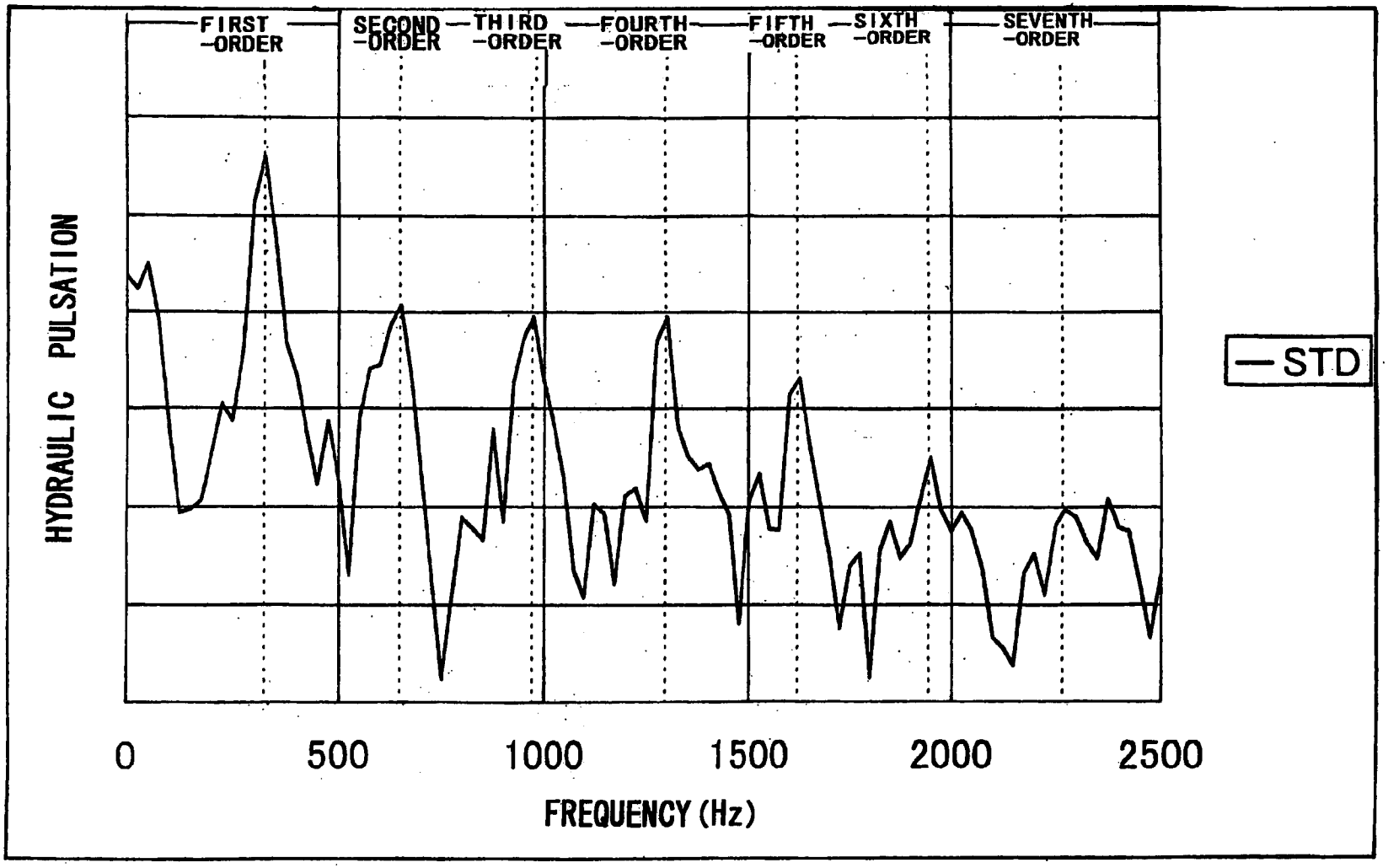
FIG. 10 is a graph showing performance in a standard value composition.

In these conditions, as shown in FIG. 10, it can be seen that the standard value (STD) graph has a waveform of regular pulsations. The graphs for pumps having a large clearance $d_1$ on two teeth and three teeth each show a significant variation in waveform compared to the standard value. In addition to the non-uniform positioning of the tip clearances $d_0$ and the large clearances $d_1$, it can be seen that the variation in waveforms also differs according to the three toothed arrangement wherein a large clearance $d_1$ is provided every other tooth or the two toothed arrangement wherein it is provided every three teeth.

Figure 8:
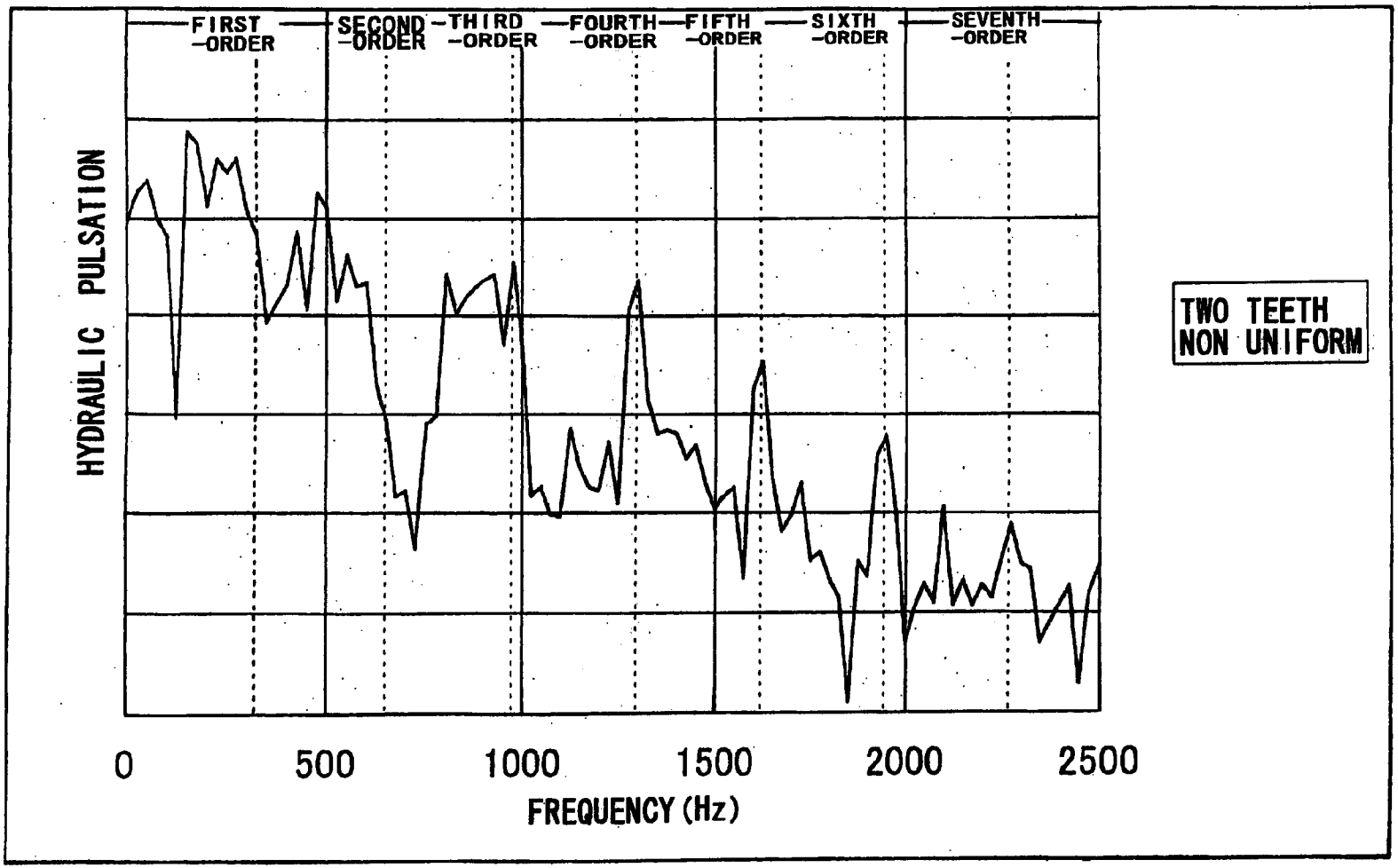
FIG. 8 is a graph showing performance in a two-tooth non-uniform composition.
Figure 9:
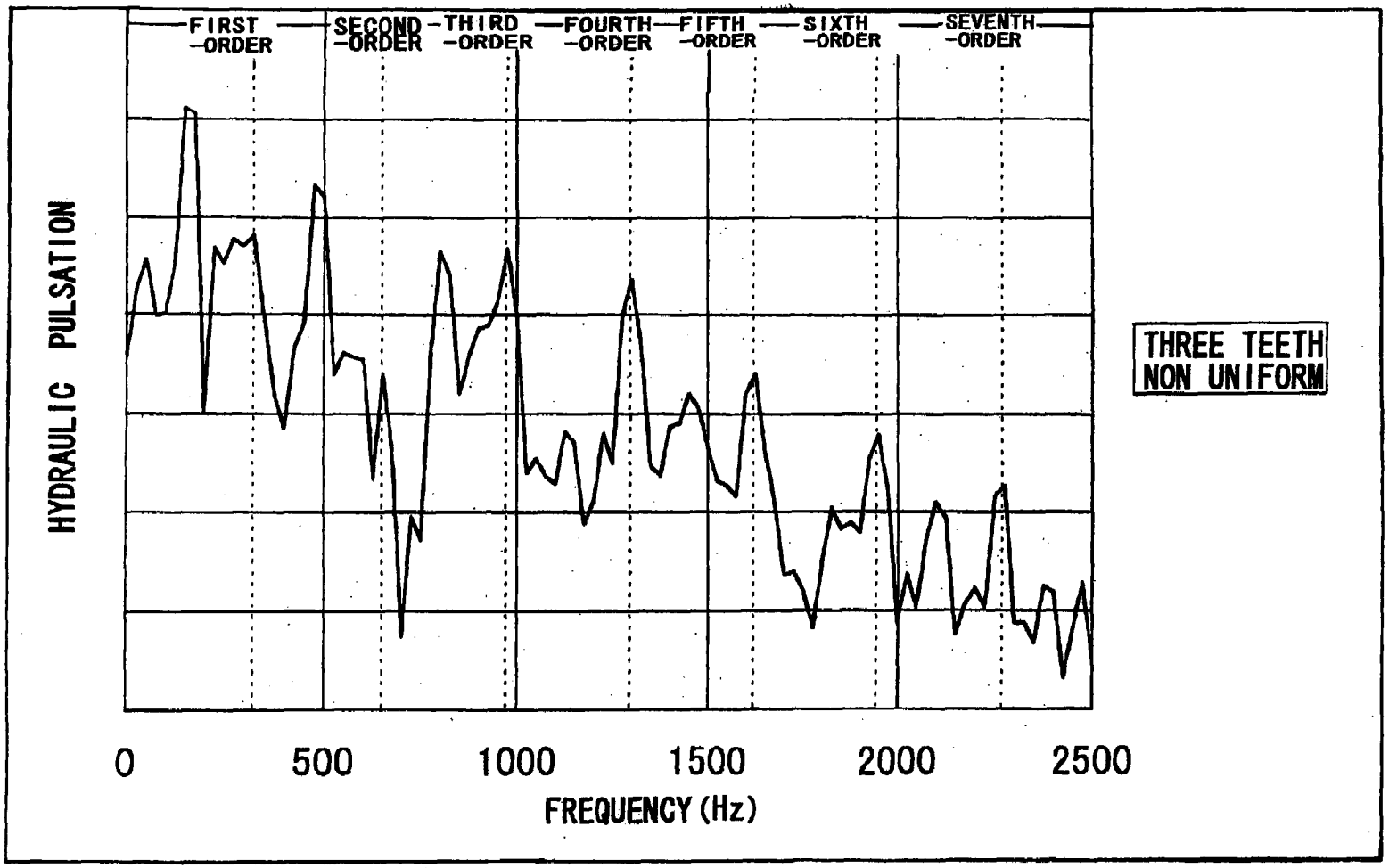
FIG. 9 is a graph showing performance in a three-tooth non-uniform composition.

Next, it can also be seen that the pumps provided with tooth crests formed with large clearances $d_1$ on two or three teeth achieve a reduction with respect to the oscillation at 324 Hz which is indicated as a frequency where a strong hydraulic pulsation is obtained in the standard value. As shown in FIG. 8 and FIG. 9, in these pumps with two or three teeth having a large clearance, the pulsation is stronger at a lower frequency than 324 Hz. Both the two and three tooth versions have a maximum pulsation at some 175 Hz lower than the standard value. By changing the strongest frequency of the pulsation in the standard value to another, lower, frequency, and increasing the surrounding frequencies, it is possible to suppress the pulsation of particular frequencies which provoke resonance, and at the same time, the oscillation caused by pulsation is prevented from extending into particular frequencies, and hence the sound generated becomes a sound which is not liable to be heard and consequently the noise can be reduced. The tooth crests 5*a* formed with a large clearance $d_1$ are tooth crests 5*a* which have a large clearance $d_1$ compared to the tooth crests 5*a* having a standard tip clearance $d_0$. To describe this in mechanical terms, the standard tip clearance $d_0$ is the clearance required to achieve a rotational sliding motion whilst respectively sealing the volume spaces created by the intermeshing of the outer rotor 6 and inner rotor 5. On the other hand, the large clearance $d_1$ is set appropriately to value whereby two volume spaces are connected.

The characteristics of the graph in FIG. 10 illustrating the standard value comprising a standard tip clearance $d_0$ only are such that a regular pointed waveform is created. This waveform is shown in first, second and third order sections in the graph. The pointed waveform is such that only the particular frequency projects significantly. The graph shows hydraulic pulsation (oscillation), but if this pulsation causes resonance with the oil filter, and the like, via the piping of the pump, thus appearing as sound, then this sound will be a particular sound having the particular frequency which projects in the graph, and it will be heard continually, thus creating an annoying noise.

The graph for the two tooth non-uniform composition (see FIG. 8) shows the waveform in a case where the rotational speed is maintained at a uniform 2000 rpm and the tip clearance $d_0$ in two of the six tooth crests of the inner rotor 5 is increased to a large clearance of $d_1$ in a rotor of the standard value (STD) described above.

Looking at the two tooth non-uniform graph, the waveform wherein a particular frequency projects in a peaked shape is reduced in comparison with the standard value. In particular, it can be seen that there is no significantly projecting waveform, as in the first, second and third-order sections of the standard value graph, the frequencies surrounding the first, second and third-order frequencies are also increased, and the projecting state of a particular frequency is eased (see corresponding portions of the graphs). Since a sound is generated at a particular frequency in the standard value design, this sound is readily audible and creates a bothersome noise. In the two tooth non-uniform composition, rather than the sound generated at a particular frequency becoming intensified, the surrounding frequencies are also increased, and hence a variety of sounds are combined together, forming a diverse sound which is not readily audible. As a result, the noise is reduced.

This occurs similarly in the case of the three-tooth non-uniform graph also. A waveform containing somewhat more projecting points than the two tooth non-uniform graph is shown. This is because three of the six tooth crests of the inner rotor 5 are formed with a large clearance $d_1$ which is greater than the tip clearance $d_0$ and hence these three tooth crests are disposed every other tooth, and the disturbance of the regularity is reduced, but since the waveform of the adjacent frequencies is increased compared to the standard value (STD), these sounds are combined together, thereby forming a diverse sound which is not readily audible and hence noise is reduced.

Figure 7:
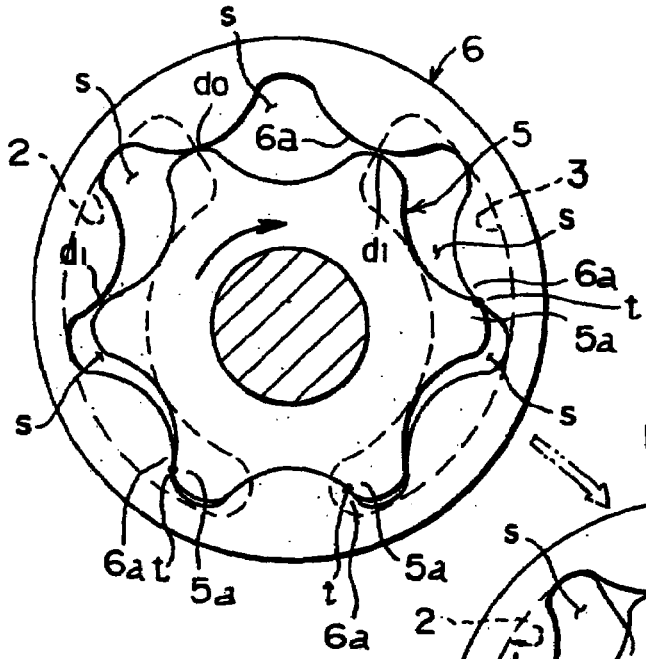
FIGS. 7(A), (B), (C) are action diagrams showing the operation of the inner rotor and outer rotor when they rotate in a stable state.
Figure 7:
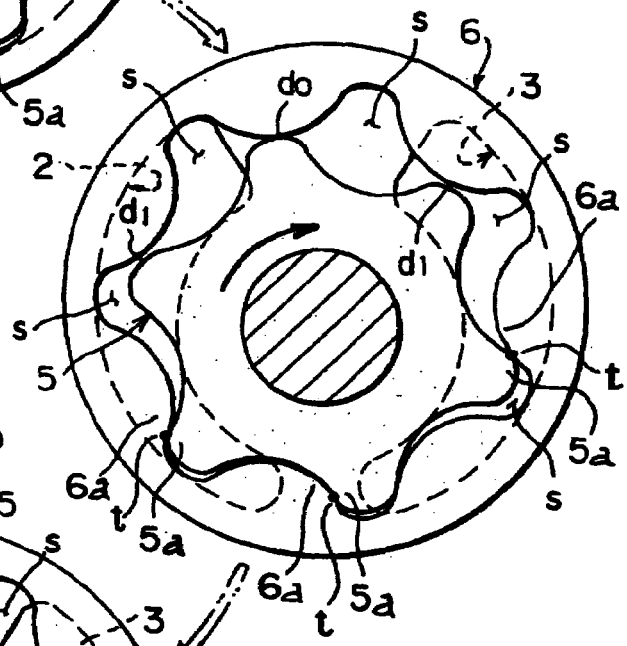
Figure 7:
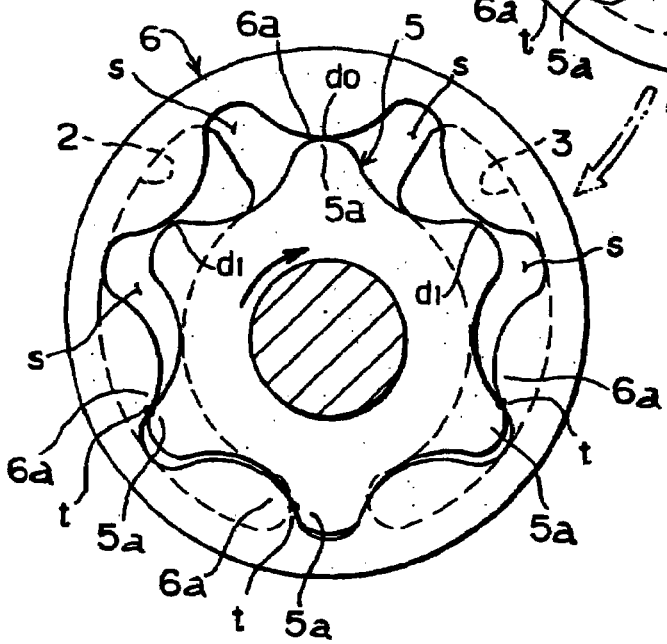

To describe how a stable rotational state is obtained in the inner rotor 5 and outer rotor 6, in the driving of the rotors, there are drive intermesh regions in two or three locations from the start end side of the intake port 2 to the finish end side thereof, as shown in FIGS. 7(A) and (B). Of the tooth crest contact regions involved in drive intermesh, there are intermeshing regions where the clearance is the standard tip clearance $d_0$, and regions where the respective tooth crests $d_0$ not make contact due to the large clearance $d_1$. Adjacent spaces, s, s are mutually interconnected via the large clearances $d_1$, thus reducing the number of enclosed spatial volumes and restricting pulsation. Moreover, in the region of the standard tip clearance $d_0$, the inner rotor 5 and outer rotor 6 support each other mutually at contact point t caused by the intermeshing of the respective tooth crests of the inner rotor 5 and the outer rotor 6, and hence play in the radial direction of the rotors can be prevented. Thereby, pulsation becomes less liable to occur and a stable rotational state can be achieved. The mutual support between the inner rotor 5 and the outer rotor 6 due to the standard tip clearance $d_0$ is also performed in the region outside the scope of the intake port 2, as illustrated in FIG. 7(C).

Figure 15:
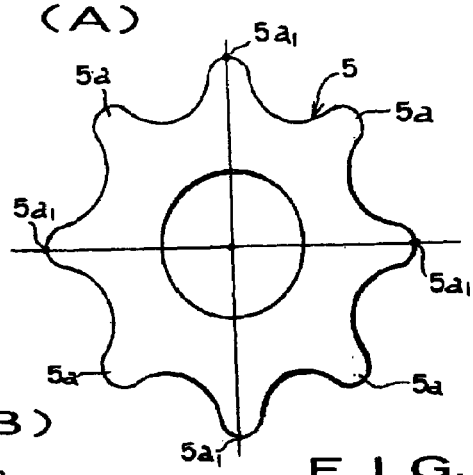
FIG. 15(A) is a plan view of an inner rotor wherein the large clearance tips are arranged in a uniform fashion.
FIG. 15(B) is a plan view of an inner rotor wherein the large clearance tips are arranged in a non-uniform fashion and FIG. 15(C) is a plan view of an inner rotor wherein the large clearance tips are arranged in a non-uniform fashion according to a different pattern.
Figure 15:
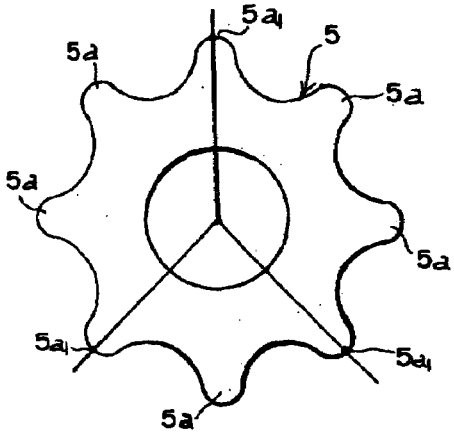
Figure 15:
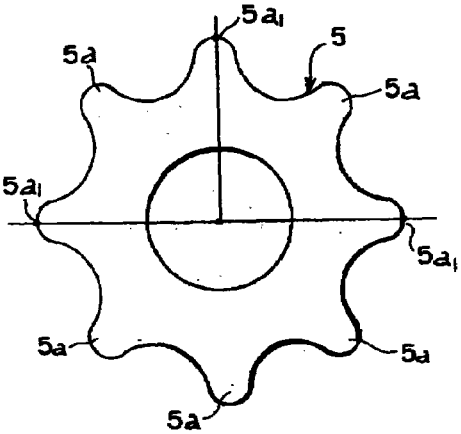

Next, there are two arrangement patterns for the plurality of large clearances $d_1$, $d_1$, . . . . In a first pattern, the plurality of large clearances $d_1$, $d_1$, . . . are arranged uniformly. For example, as shown in FIG. 15(A), if the number of teeth in the inner rotor 5 is eight, then large clearance tips 5*a*, on tooth crests 5*a* formed with a large clearance d, are provided every other tooth.

In a second pattern for arrangement of a plurality of large clearances $d_1$, $d_1$, . . . , this plurality of large clearances $d_1$, $d_1$, . . . are arranged in a non-uniform fashion. For example, if the inner rotor 5 has eight teeth, similarly to the first pattern, then as shown in FIG. 15(B), after a first large clearance tip $5a_1$ where a tooth crest 5*a* is formed with a large clearance $d_1$, the next large clearance tip $5a_1$ is formed at a spacing of three teeth. Thereupon, the next large clearance tip $5a_1$ is formed at a further spacing of two teeth. Moreover, as shown in FIG. 15(C), after a first large clearance tip $5a_1$ where a tooth crest 5*a* is formed with a large clearance $d_1$, the next large clearance tip $5a_1$ may be formed at a spacing of two teeth. Thereupon, the next large clearance tip $5a_1$ is formed at a further spacing of four teeth.

In this way, the large clearance tips $5a_1$ where tooth crests 5*a* are provided with a large clearance $d_1$ are formed appropriately, in such a manner that there is no regularity in the positioning of the large clearance tips $5a_1$, $5a_1$, . . . forming the large clearances $d_1$, $d_1$, . . . . This non-uniform arrangement of the large clearances $d_1$, $d_1$, . . . is also performed if the inner rotor 5 has an odd number of teeth.

The patterns where the aforementioned large clearances $d_1$, $d_1$, . . . are arranged in uniform or non-uniform fashion were described on the basis of the inner rotor 5, but it is of course possible to base the uniform or non-uniform arrangement pattern of the large clearances $d_1$, $d_1$, . . . on the outer rotor 6, and to set the arrangement of the tooth crests 6*a*, 6*a*, . . . formed with large clearances $d_1$, $d_1$, . . . appropriately. A uniform arrangement of this plurality of large clearances $d_1$, $d_1$, . . . is possible in the case of a rotor with six or four teeth, as well as one with eight teeth, but it is conditioned upon the fact that the number of teeth is even.

Figure 16:
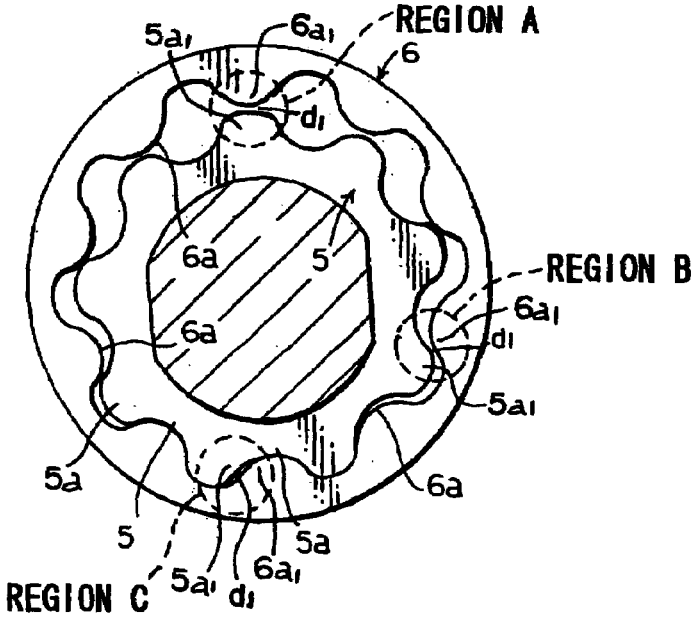
FIG. 16 is a plan view showing the shape of a large clearance tip formed by an inner rotor and outer rotor.

In the present invention, the large clearance $d_1$ in the position of region (A) in FIG. 16 is taken to be the same large clearance $d_1$ as the large clearances $d_1$ in the positions of regions (B) and (C). In other words, when a space s is formed between the inner rotor 5 and outer rotor 6, if the minimum space between the tooth crest 5*a* of the inner rotor 5 and the tooth crest 6*a* of the outer rotor 6 enclosing the space s is greater than the standard tip clearance $d_0$, then this is taken as a large clearance $d_1$.

Therefore, in the present invention, the large clearance $d_1$ at the position where the respective foremost ends of the tooth crest 5*a* of the inner rotor 5 and the tooth crest 6*a* of the outer rotor 6 are mutually opposing, as in region (A) in FIG. 16, and the large clearance $d_1$ at the position where the front crest 5*a* and front crest 6*a* are mutually opposing in positions wherein the respective foremost ends thereof are mutually displaced, as in region (B) and region (C) in FIG. 16, are treated as large clearances $d_1$ of the same conditions. In other words, in the arrangement of the large clearances $d_1$, $d_1$, . . . described above, region (A), region (B) and region (C) illustrated in FIG. 16 are mixed together appropriately, and they are distributed in a uniform or non-uniform manner.

Next, in terms of the interval dimensions of the plurality of large clearances $d_1$, $d_1$, . . . , there are the following plurality of patterns. Firstly, in a first pattern of interval dimensions, the interval dimensions of all of the large clearances $d_1$, $d_1$, . . . formed are taken to be the same. In other words, the respective large clearances $d_1$, $d_1$, . . . at region (A), region (B) and region (C) in FIG. 16 all have the mutually equal interval dimensions, as described previously. In this case, the fluid interconnected between the spaces s via the large clearance $d_1$ is the same in each of the locations of the large clearances $d_1$, $d_1$, . . . . Consequently, the non-regularity of the pulsation during operation of the pump is generated at two different positions, those of the tip clearance $d_0$ and the large clearance $d_1$, thus producing a simple non-regularity.

Next, in a second pattern for interval dimensions, the interval dimensions of all of the large clearances $d_{11}$, $d_{12}$, . . . formed are mutually different, and there exist no large clearances $d_1$, $d_1$, . . . which have the same interval dimensions. Here, the addition of suffixes to the large clearances $d_{11}$, $d_{12}$, . . . makes it easier to distinguish between the respective large clearances $d_1$, $d_1$, . . . , in cases where the interval dimensions thereof are mutually different, as described above. In other words, in this case, the amount of fluid connected between spaces s via the large clearance $d_1$ is different in each of the respective large clearances $d_{11}$, $d_{12}$, . . . . Therefore, the non-regularity of the pulsation during pump operation is generated not only by the tip clearance $d_0$ and the large clearance $d_1$, but also by the plurality of different large clearances $d_{11}$, $d_{12}$, . . . . In this second pattern of interval dimensions, the non-regularity of the pulsation is enhanced.

Next, in a third pattern of interval dimensions, the interval dimension of at least one large clearance $d_1'$ of the plurality of large clearances $d_1$, $d_1$, . . . formed is different from the interval dimensions of the other large clearances $d_1$, $d_1$, . . . . For example, if there are four large clearances $d_1$, $d_1$, . . . in a rotor set comprising an inner rotor 5 and outer rotor 6, then one of these large clearances $d_1'$ is set to a different interval dimension from the other three large clearances $d_1$, $d_1$, . . . . In this third pattern of interval dimensions, the non-regularity of pulsation is approximately midway between that of the first pattern and the second pattern. The (') symbol in the large clearance $d_1'$ described above is used to distinguish it readily from the other large clearances $d_1$, $d_1$, . . . .

Figure 13:
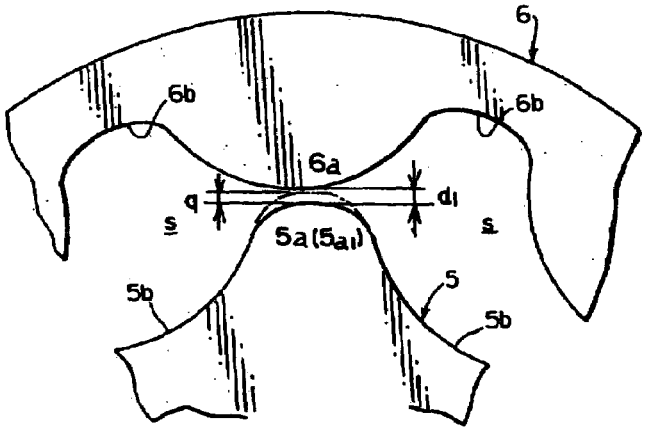
FIG. 13 is an enlarged plan view of a large clearance formed by a large clearance tip on the inner rotor alone.
Figure 14:
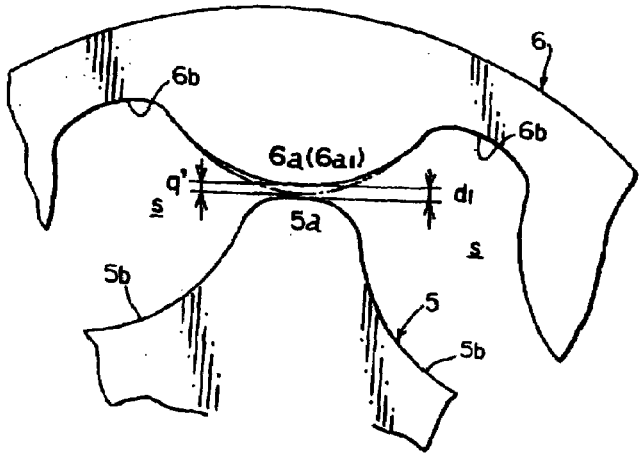
FIG. 14 is an enlarged plan view of a large clearance formed by a large clearance tip on the outer rotor alone.

Next, with regard to the formation of the large clearances $d_1$, $d_1$, . . . , as described previously, large clearances $d_1$ are created by forming large clearance tips $5a_1$ on tooth crests 5*a* of the inner rotor 5, or by forming large clearance tips $6a_1$ on the tooth crests 6*a* of the outer rotor. There are a plurality of patterns for forming the large clearances $d_1$ and in a first formation pattern, the large clearances $d_1$ are formed only on large clearance tips $5a_1$ on the inner rotor 5 (see FIG. 13), or they are formed only on large clearance tips $6a_1$ on the outer rotor 6 (see FIG. 14). In this first formation pattern, the large clearances $d_1$, $d_1$, . . . are formed in such a manner that all have the same interval dimensions, as described in the interval dimension patterns for the large clearances $d_1$ mentioned above.

In other words, if the large clearances $d_1$ are formed only on large clearance tips $5a_1$ on the inner rotor 5, then the tooth crests are retracted by an even amount and the plurality of large clearance tips $5a_1$, $5a_1$, . . . are formed to an even size, whereby the interval dimensions of all of the large clearances $d_1$, $d_1$, . . . are made equal, as described above. In this respect, it is also possible to form large clearances $d_1$, $d_1$, . . . by setting large clearance tips $6a_1$, $6a_1$, . . . on the outer rotor to mutually equal size.

Furthermore, in the second formation pattern, the tooth crests 5*a* are retracted by mutually different amounts, thereby causing the size-of a plurality of large clearance tips $5a_{11}$, $5a_{12}$, . . . to be mutually different, and hence the interval dimensions of all of the large clearances $d_{11}$, $d_{12}$, . . . formed are mutually different, as described previously. In the case of these large clearance tips $5a_{11}$, $5a_{12}$, . . . , the addition of the suffixes makes it easier to distinguish between a plurality of large clearance tips $5a_1$, $5a_1$, . . . each of which has been retracted by a different amount.

Moreover, in the third formation pattern, by setting a suitable one large clearance tip $5a_1'$ of a plurality of large clearance tips $5a_{11}$, $5a_{12}$, . . . to a different size to that of the other large clearance tips $5a_{11}$, $5a_{12}$, . . . , then it is possible to make the interval dimension of at least one large clearance $d_1$ of the plurality of large clearances $d_{11}$, $d_{12}$, . . . differ from the interval dimensions of the other large clearances $d_1$, $d_1$, . . . .

In the description of the second and third formation patterns explained above, the large clearances $d_{11}$, $d_{12}$, . . . were constituted by forming a plurality of large clearance tips $5a_{11}$, $5a_{12}$, . . . on the inner rotor 5, but it is also possible to set a plurality of large clearance tips $6a_{11}$, $6a_{12}$, . . . on the outer rotor 6 to mutually different sizes, or to set a suitable one large clearance tip $6a_1$ of a plurality of large clearance tips $6a_{11}$, $6a_{12}$, . . . on the outer rotor 6 to a different size from the other large clearance tips $6a_1$, $6a_1$, . . . . The addition of suffixes to the large clearance tips $6a_{11}$, $6a_{12}$, . . . makes it easier to distinguish between the large clearance tips 6*a*, 6*a*, . . . of mutually different sizes.

Figure 11:
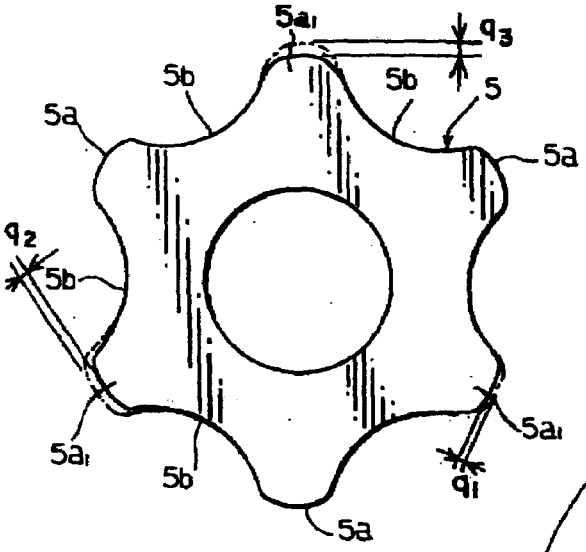
FIG. 11(A) is a plan view showing the amount of retraction of respective large clearance tips of an inner rotor.
FIG. 11(B) is a plan view showing the amount of retraction of respective large clearance tips of an outer rotor and FIG. 11(C) is an enlarged plan view of a maximum clearance formed by the respective large clearance tips of the inner rotor and the outer rotor.
Figure 11:
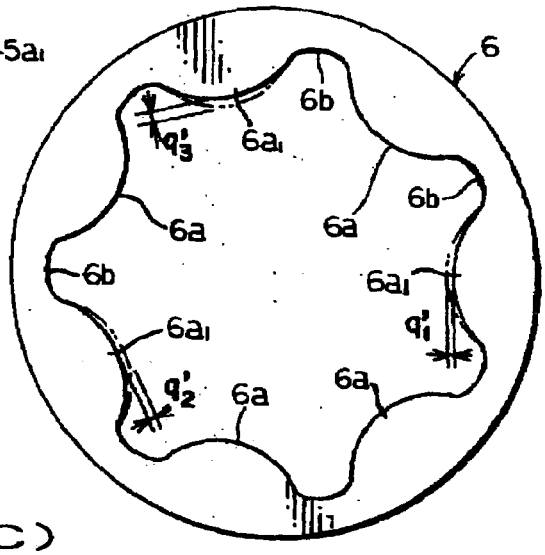
Figure 11:
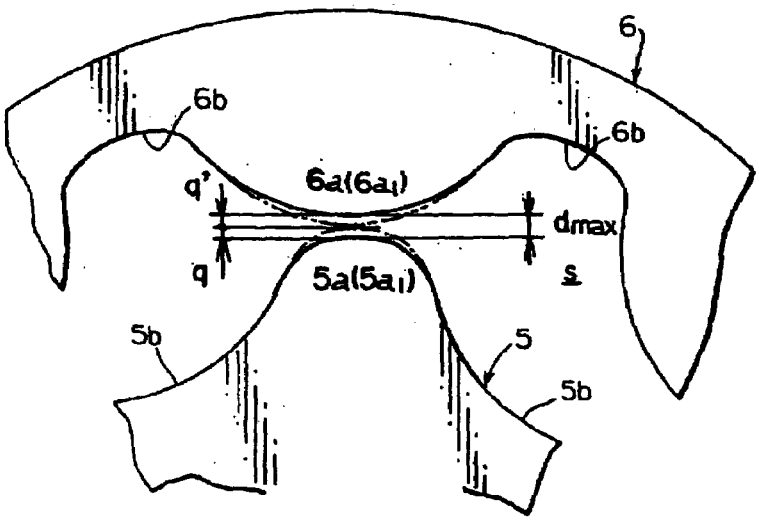

Moreover, in a fourth formation pattern for the large clearances $d_1$, $d_1$, . . . , as shown in FIGS. 11(A) and (B), large clearance tips $5a_1$ are formed on tooth crests 5*a* of the inner rotor 5, and furthermore, large clearance tips $6a_1$ are formed on the tooth crests 6*a* of the outer rotor 6. When a large clearance tip $5a_1$ on the inner rotor 5 is opposing a tooth crest 6*a* on the outer rotor 6, or when a large clearance tip $6a_1$ of the outer rotor 6 is opposed a tooth crest 5*a* of the inner rotor 5, then the aforementioned large clearance $d_1$ is created, and moreover, when a large clearance tip $5a_1$ of the inner rotor 5 is opposing a large clearance tip $6a_1$ of the outer rotor 6, then a maximum clearance $d_{max}$, which is larger than the large clearance $d_1$, is created.

As shown in FIG. 11(C), this maximum clearance $d_{max}$ is the sum of the greatest amount of retraction q of the large clearance tip $5a_1$ and the greatest amount of retraction q' of the large clearance tip $6a_1$, and in terms of an equation, $d_{max}=q+q'$.

The maximum clearance $d_{max}$ has an interval dimension which is greater than the standard large clearance $d_1$, in other words, the large clearance $d_1$ created by the retraction of the circumferential edge of one only of either a tooth crest 5*a* of the inner rotor 5 or a tooth crest 6*a* of the outer rotor 6.

Figure 12:
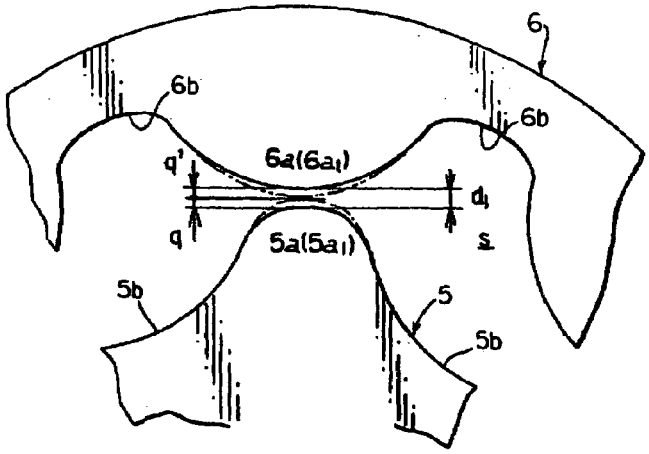
FIG. 12 is an enlarged plan view of a large clearance formed on a large clearance tip which is greater than the respective tip clearances of the inner rotor and outer rotor.

Next, in a fifth formation pattern for the large clearances $d_1$, $d_1$, . . . , as shown in FIG. 12, the large clearance $d_1$ may be formed by means of a large clearance tip $5a_1$ on the inner rotor 5 and a large clearance tip $6a_1$ on the outer rotor 6.

In the fourth pattern and fifth formation patterns described above, by setting the respective amounts of retraction q, q, . . . of the large clearance tips $5a_1$, $5a_1$, . . . of the inner rotor 5 to the same or mutually different amounts, and by setting the respective amounts of retraction q', q', . . . of the large clearance tips $6a_1$, $6a_1$, . . . of the outer rotor 6 to the same or mutually different amounts, then it is possible to set the plurality of large clearances $d_{11}$, $d_{12}$, . . . formed by these large clearance tips $5a_1$, $6a_1$ to have respectively the same or mutually different interval dimensions.

For example, if the respective amounts of retraction $q_1$, $q_2$, $q_3$ of the respective large clearance tips $5a_1$, $5a_1$, . . . on the inner rotor 5 are considered, then the following mutual relationships exist between these respective amounts of retraction.

(1) $q_1=q_2=q_3$, (2) $q_1\neq q_2\neq q_3$, (3) $q_1=q_2\neq q_3$, (4) $q_1\neq q_2=q_3$, (5) $q_1=q_3\neq q_2$, Moreover, the relative magnitudes of the retraction amounts $q_1$, $q_2$, $q_3$ are as follows.

(6) $q_1>q_2$, (7) $q_1<q_2$, (8) $q_2>q_3$, (9) $q_2<q_3$, (10) $q_1>q_3$, (11) $q_1<q_3$.

Similarly, if the respective amounts of retraction $q_1'$, $q_2'$, $q_3'$ of the respective large clearance tips $6a_1$, $6a_1$, . . . on the outer rotor 6 are considered, then the following mutual relationships exist between these respective amounts of retraction.

(1) $q_1'=q_2'=q_3'$, (2) $q_1'\neq q_2'\neq q_3'$, (3) $q_1'=q_2'\neq q_3'$, (4) $q_1'\neq q_2'=q_3'$, (5) $q_1'=q_3'\neq q_2'$, Moreover, the relative magnitudes of the retraction amounts $q_1$, $q_2$, $q_3$ are as follows.

(6) $q_1'>q_2'$, (7) $q_1'<q_2'$, (8) $q_2'>q_3'$, (9) $q_2'<q_3'$, (10) $q_1'>q_3'$, (11) $q_1'<q_3'$,

In a composition wherein a maximum clearance $d_{max}$ according to the fourth pattern and large clearances $d_1$ according to the fifth pattern are formed by means of large clearance tips $5a_1$ on the inner rotor 5 and large clearance tips $6a_1$ on the outer rotor 6, then if the conditions of the amounts of retraction of the large clearance tips $5a_1$ on the inner rotor 5 are $q_1=q_2=q_3$, and the amounts of retraction of the large clearance tips $6a_1$ on the outer rotor 6 are $q_1'=q_2'=q_3'$, the maximum clearance $d_{max}$ and the large clearances $d_1$ created by the inner rotor 5 and the outer rotor 6 will be uniform values.

Moreover, if the conditions of the amounts of retraction of the inner rotor 5 are taken to be $q_1\neq q_2\neq q_3$, and the amounts of retraction of the outer rotor 6 are taken to be $q_1'\neq q_2\neq q_3'$, then there will exist various combinations of values for the maximum clearance $d_{max}$ in the fourth pattern and the large clearance $d_1$ in the fifth pattern, as created by the inner rotor 5 and outer rotor 6.

The maximum clearance $d_{max}$ in the fourth pattern will be of a varying size, whilst the large clearance $d_1$ in the fifth pattern will be of uniform size.

In other words, in the case of the maximum clearance $d_{max}$, in the fourth pattern, since the maximum clearance $d_{max}$ and the retraction amounts forming it are different on the inner rotor 5 and the outer rotor 6, large clearances $d_1$ of a variety of sizes are formed when opposing a tooth crest 5*a* on the inner rotor or a tooth crest 6*a* on the outer rotor 6.

Moreover, in the case of the large clearance $d_1$ in the fifth pattern, although the large clearances $d_1$ created by the combination of rotors will be of uniform size, since the amounts of retraction forming these clearances are different on the inner rotor 5 and the outer rotor 6, the large clearance $d_1$ greater than the tip clearance $d_0$, which is formed when opposing the tooth crest 5*a* of the inner rotor 5 or the tooth crest 6*a* of the outer rotor 6, will be of varying size. The combinations of maximum clearance $d_{max}$ in the fourth pattern and the respective amounts of retraction in the large clearance $d_1$ in the fifth pattern are as described below.

(1) $q_1+q_1'$, (2) $q_1+q_2'$, (3) $q_1+q_3'$,
(4) $q_2+q_1'$, (5) $q_2+q_2'$, (6) $q_2+q_3'$,
(7) $q_3+q_1'$, (8) $q_3+q_2$, (9) $q_3+q_3'$.

The plurality of large clearances $d_1$, $d_1$, . . . or the maximum clearance $d_{max}$ are constituted by the aforementioned combinations, and the interval dimensions of the respective large clearances $d_1$, $d_1$, . . . based on the respective amounts of retraction described above are respectively different, which means that when the pump operates, since the large clearances $d_1$, $d_1$, . . . each have mutually different interval dimensions, it is possible to generate non-regularity in the pulsing action.

The invention according to a first claim concerns a trochoidal pump wherein an inner rotor 5 and an outer rotor 6 having trochoidal toothed shapes are provided in a mutually intermeshing state, in such a manner that a tip clearance $d_0$ is created between each tooth crest 5*a* of the inner rotor 5 and the outer rotor 6, a large clearance $d_1$ forming a large interval being provided in at least one location of the group of the tip clearances $d_0$, whereby pulsation can be suppressed whilst maintaining volume efficiency.

In other words, there are tip clearances $d_0$, $d_0$, . . . between the inner rotor 5 and the outer rotor 6, at least one of this group of tip clearances $d_0$ being set to a large clearance $d_1$ forming a large interval, and by including a large clearance $d_1$ in the group of tip clearances $d_0$, the regular pulsation generated by a group of tip clearances $d_0$ only, which in turn causes resonance in the trochoidal pump itself and in the peripheral devices, becomes a pulsation of a non-regular cycle, and hence the aforementioned resonance is prevented and noise can be suppressed to a low level. By consequence, it is also possible greatly to improve the lifespan of both the trochoidal pump and the peripheral devices supplied with fluid by the trochoidal pump.

Moreover, since a large clearance $d_1$ is simply included in the group of tip clearances $d_0$ between the inner rotor 5 and outer rotor 6, this composition can be adopted readily. This can be achieved by forming a tooth crest of either the inner rotor 5 or the outer rotor 6 to a slightly lower shape, and hence the aforementioned merits can be obtained by means of an extremely simple composition.

The invention according to a second claim concerns the trochoidal pump of the first claim, wherein the number of teeth of the inner rotor 5 is six or more, and a large clearance $d_1$ is formed between the inner rotor 5 and the outer rotor 6, on the plurality of tooth crests 5*a* of the inner rotor 5, at least at every other tooth position, whereby, if the inner rotor 5 (or outer rotor 6) has six or more teeth, the positions at which the clearance created between a tooth crest 5 of the inner rotor and the outer rotor 6 becomes a large clearance $d_1$ are set to be at least every other tooth position of the inner rotor 5, and by selecting the number and arrangement thereof appropriately, a variety of pump performances can be provided readily. Moreover, if the maximum setting number of three tip clearances $d_0$ and three large clearances $d_1$ provided on alternate teeth is adopted, then although the large clearances $d_1$, $d_1$, . . . form a tooth shape which does not perform rotational drive of the rotors, since they form an interconnected state during intermeshing of the rotors, they allow a well balanced arrangement of the tip clearances $d_0$ which maintain rotational drive intermeshing of the rotors, and hence the rotation of the rotors can be stabilized.

In other words, there are drive intermesh sections in two to three positions between the start end side and the finish end side of the intake port 2, and of the tooth crest contact regions involved in drive intermesh, there are intermeshing regions where the clearance is the standard tip clearance $d_0$, and regions where the respective tooth crests $d_0$ not make mutual contact due to the large clearance $d_1$, the adjacent spaces, s, s being mutually interconnected via the large clearances $d_1$, thus reducing the number of enclosed spatial volumes and restricting pulsation. Moreover, in the region of the standard tip clearance $d_0$, the inner rotor 5 and outer rotor 6 support each other mutually due to intermeshing between the respective tooth crests of the inner rotor 5 and the outer rotor 6, and hence play in the radial direction of the rotors can be prevented, thereby making pulsation becomes less liable to occur and making it possible to achieve a stable rotational state.

The invention according to the third claim concerns the trochoidal pump according to claims 1 or 2, wherein, taking the number of teeth of the inner rotor 5 or outer rotor 6 as n, large clearances $d_1$, $d_1$, . . . are arranged in a uniform or non-uniform fashion on appropriate tooth crests 5*a*, 6*a* of the teeth, whereby the large clearances $d_1$, $d_1$, . . . are arranged in a uniform or non-uniform fashion, and together with the standard tip clearances do, they are able to generate non-regularity in the pulsation caused by the operation of the pump, thus increasing the degree to which resonance can be prevented and noise can be reduced to a low level.

The invention according to the fourth claim concerns the trochoidal pump according to claim 1, 2 or 3, wherein the number of teeth, n, of the inner rotor 5 is set to an even number, and a large clearance $d_1$ is provided every other tooth on (n/2) tooth crests, whereby, if the number of teeth, n, of the inner rotor (or the outer rotor 6) is an even number, then the tooth crests forming a large clearance $d_1$ can be set to be at least in every other tooth position. Therefore, if the number of teeth n is even, the regions formed with a large clearance $d_1$ can be set to n/2 regions, and a well-balanced arrangement between the tip clearance $d_0$ and the large clearance $d_1$ can be achieved, thus making it possible to suppress pulsation whilst maintaining volume efficiency.

The invention according to the fifth claim concerns the trochoidal pump according to claim 1, 2 or 3, wherein the number of teeth, n, of the inner rotor 5 is set to an odd number, and a large clearance $d_1$ is provided at least every other tooth position or every other two tooth positions, on ((n−1)/2) tooth crests, whereby the sequence of the positions of the tip clearances $d_0$ and large clearances $d_1$ becomes non-uniform, rather than being systematic, in addition to which the positioning of the tooth crests having large clearance $d_1$ becomes non-uniform, thereby disturbing the regularity of the hydraulic pulsations, avoiding resonance, and hence making it possible suppress pulsation whilst ensuring volume efficiency.

The invention according to the sixth claim concerns the trochoidal pump according claim 1, 2, 3, 4 or 5, wherein there are a plurality of the large clearances $d_1$, and all of these large clearances $d_1$, $d_1$, . . . have the same interval dimension, whereby a non-regularity in the pulsation caused when the pump operates can be generated by the standard tip clearances $d_0$, $d_0$, . . . and the large clearances $d_1$, $d_1$, . . . , and moreover, since the plurality of large clearances $d_1$, $d_1$, . . . are formed with the same interval dimensions, the composition becomes extremely simple, and the structure of the inner rotor 5 or outer rotor 6 for forming the large clearances $d_1$, $d_1$, . . . can be achieved in a comparatively easy fashion.

The invention according to the seventh claim concerns the trochoidal pump according to claim 1, 2, 3, 4 or 5, wherein there are a plurality of the large clearances $d_1$, and all of these large clearances $d_1$, $d_1$, . . . have mutually different interval dimensions, whereby, in addition to the non-regularity of the pulsation caused by the tip clearances $d_0$ and the large clearances $d_1$, the non-regularity of the pulsation caused when the pump operates is further increased by the non-regularity of the pulsation caused by the plurality of large clearances $d_1$, thereby increasing the degree to which resonance can be prevented and noise can be reduced to a low level.

The invention according to the eighth claim concerns the trochoidal pump according to claim 1, 2, 3, 4, or 5, wherein there are a plurality of the large clearances $d_1$, and at least one of all of these large clearances $d_1$, $d_1$, . . . has a different interval dimension to the other large clearances $d_1$, whereby, in addition to the non-regularity of the pulsation caused by the tip clearances $d_0$ and the large clearances $d_1$, since at least one large clearance $d_1$ of the plurality of large clearances $d_1$, $d_1$, . . . has a different interval dimension to the other large clearances $d_1$, it is also possible to generate non-regularity in the pulsation by means of the large clearances $d_1$, $d_1$, . . . alone, thus increasing the degree to which resonance can be prevented and the noise can be suppressed to a low level.

The invention according to the ninth claim concerns the trochoidal pump according to claim 1, 2, 3, 4, 5, 6, 7 or 8, wherein the large clearances $d_1$ are formed by retracting the circumferential edges of either tooth crests 5*a* of the inner rotor 5 or tooth crests 6*a* of the outer rotor 6, whereby the structure can be achieved in an extremely easy fashion, since the circumferential edges of tooth crests of either the inner rotor 5 or outer rotor 6 are retracted.

The invention according to the tenth claim concerns the trochoidal pump according to claim 1, 2, 3, 4, 5, 6, 7 or 8, wherein the large clearances $d_1$ are formed by retracting the circumferential edges of both tooth crests 5*a* of the inner rotor 5 and tooth crests 6*a* of the outer rotor 6, whereby there will exist large clearances $d_1$ of the plurality of large clearances $d_1$, $d_1$, . . . , which are formed by a large clearance tip 5*a*$_1$ of the inner rotor 5 and a large clearance tip 6*a*$_1$ of the outer rotor 6.

If a large clearance tip 5*a*$_1$ and large clearance tip 6*a*$_1$ become mutually opposing due to rotation of the rotors, then a particularly big large clearance $d_1$ (in other words, a maximum clearance $d_{max}$) will occur amongst the large clearances $d_1$, $d_1$, . . . , and by retracting the tooth crests 5*a* of the inner rotor 5 and the tooth crests 6*a* of the outer rotor appropriately, it is possible to provide large clearances $d_1$ of a variety of sizes, whereby the non-regularity of the pulsation caused by pump operation becomes even more pronounced, thus increasing the degree to which the resonance can be prevented and noise can be reduced to a low level. In the foregoing case, $d_{max}$=q+q'.

Moreover, when a large clearance tip 5*a*$_1$ and a large clearance tip 6*a*$_1$ oppose each other due to rotation of the rotors, large clearances $d_1$, $d_1$, . . . are formed, and when a tooth crest 5*a* of the inner rotor 5 or a tooth crest 6*a* of the outer rotor 6 opposes such a large clearance tip 5*a*$_1$ or large clearance tip 6*a*$_1$, then a large clearance $d_1$ which is greater than the tip clearance $d_0$ but smaller than the aforementioned large clearance $d_1$ (equal to the maximum clearance $d_{max}$) is formed, whereby the large clearance $d_1$ can be set to a variety of sizes by means of retracting the tooth crests 5*a* of the inner rotor 5 and the tooth crests 6*a* of the outer rotor 6 by appropriate amounts, thus enhancing the non-regularity of the pulsation during pump operations, and increasing the degree to which resonance can be prevented and noise reduced to a low level. In the foregoing, $d_1$=q+q'.

What is claimed is:

1. A trochoidal pump comprising:

an inner rotor and an outer rotor having trochoidal toothed shapes, the inner rotor and outer rotor being provided in a mutually intermeshing state such that a normal tip clearance occurs between each tooth crest of the inner rotor and the outer rotor, wherein at least one tip end of the plurality of tooth crests on at least one of the inner rotor and the outer rotor is selected appropriately and retracted such that a large clearance, which is a larger gap than the normal tip clearance, is provided by the tooth crest on the at least one of the inner rotor and the outer rotor having the retracted tip end.

2. The trochoidal pump according to claim 1, wherein the number of teeth of said inner rotor is at least six, and a large clearance is formed between said inner rotor and said outer rotor, on the plurality of tooth crests of said inner rotor, at least at every other tooth position.

3. The trochoidal pump according to claim 2, wherein taking the number of teeth of at least one of said inner rotor and said outer rotor as n, large clearances are arranged in one of a uniform fashion and a non-uniform fashion on appropriate tooth crests of said teeth.

4. The trochoidal pump according claim 2, wherein there are a plurality of said large clearances, and all of said large clearances have the same interval dimension.

5. The trochoidal pump according to claim 2, wherein there are a plurality of said large clearances, and all of said large clearances have mutually different interval dimensions.

6. The trochoidal pump according to claim 2, wherein there are a plurality of said large clearances, and at least one of said large clearances has a different interval dimension than the other large clearances.

7. The trochoidal pump according to claim 2, wherein said large clearances are formed by retracting the circumferential edges of one of tooth crests of said inner rotor and tooth crests of the outer rotor.

8. The trochoidal pump according to claim 2, wherein said large clearances are formed by retracting the circumferential edges of both tooth crests of said inner rotor and tooth crests of the outer rotor.

9. The trochoidal pump according to claims 1, wherein, taking the number of teeth of at least one of said inner rotor and said outer rotor as n, large clearances are arranged in one of a uniform fashion and a non-uniform fashion on appropriate tooth crests of said teeth.

10. The trochoidal pump according claim 1, wherein there are a plurality of said large clearances, and all of said large clearances have the same interval dimension.

11. The trochoidal pump according to claim 1, wherein there are a plurality of said large clearances, and all of said large clearances have mutually different interval dimensions.

12. The trochoidal pump according to claim 1, wherein there are a plurality of said large clearances, and at least one of said large clearances has a different interval dimension to the other large clearances.

13. The trochoidal pump according to claim 1, wherein said large clearances are formed by retracting the circumferential edges of either one of tooth crests of said inner rotor and tooth crests of the outer rotor.

14. The trochoidal pump according to claim 1, wherein said large clearances are formed by retracting the circumferential edges of both tooth crests of said inner rotor and tooth crests of the outer rotor.

15. A trochoidal pump comprising:

an inner rotor and an outer rotor having trochoidal toothed shapes provided in a mutually intermeshing state, such that a tip clearance is created between each tooth crest of the inner rotor and the outer rotor, wherein at least one tooth crest is retracted to form a large clearance, the large clearance being greater than the tip clearance, and a number of teeth, n, of said inner rotor is set to an even number, and said large clearance is provided every other tooth on (n/2) tooth crests.

16. A trochoidal pump comprising:

an inner rotor and an outer rotor having trochoidal toothed shapes provided in a mutually intermeshing state, such that a tip clearance is created between each tooth crest of the inner rotor and the outer rotor, wherein at least one tooth crest is retracted to form a large clearance, the large clearance being greater than the tip clearance, and a number of teeth, n, of said inner rotor is set to an odd number, and said large clearance is provided at least every other tooth position or every other two tooth positions, on ((n−1)/2) tooth crests.

17. A trochoidal pump comprising:

an inner rotor and an outer rotor having trochoidal toothed shapes provided in a mutually intermeshing state, such that a tip clearance is created between each tooth crest of the inner rotor and the outer rotor, wherein at least one tooth crest is retracted to form a large clearance, the large clearance being greater than the tip clearance, a number of teeth, n, of said inner rotor is at least six, and said large clearance is formed between said inner rotor and said outer rotor, on the plurality of tooth crests of said inner rotor, at least at every other tooth position, and the number of teeth, n, of said inner rotor is set to an even number, and said large clearance is provided every other tooth on (n/2) tooth crests.

18. A trochoidal pump comprising:

an inner rotor and an outer rotor having trochoidal toothed shapes provided in a mutually intermeshing state, such that a tip clearance is created between each tooth crest of the inner rotor and the outer rotor, wherein at least one tooth crest is retracted to form a large clearance, the large clearance being greater than the tip clearance, taking a number of teeth of at least one of said inner rotor and said outer rotor as n, large clearances are arranged in one of a uniform and a non-uniform fashion on appropriate tooth crests of said teeth, and a number of teeth, n, of said inner rotor is set to an even number, and said large clearance is provided every other tooth on (n/2) tooth crests.

19. A trochoidal pump comprising:

an inner rotor and an outer rotor having trochoidal toothed shapes provided in a mutually intermeshing state, such that a tip clearance is created between each tooth crest of the inner rotor and the outer rotor, wherein at least one tooth crest is retracted to form a large clearance, the large clearance being greater than the tip clearance, a number of teeth, n, of said inner rotor is at least six, and the large clearance is formed between said inner rotor and said outer rotor, on the plurality of tooth crests of said inner rotor, at least at every other tooth position, and the number of teeth, n, of said inner rotor is set to an odd number, and said large clearance is provided one of at least every other tooth position and every other two tooth positions, on ((n−1)/2) tooth crests.

20. A trochoidal pump comprising:

an inner rotor and an outer rotor having trochoidal toothed shapes provided in a mutually intermeshing state, such that a tip clearance is created between each tooth crest of the inner rotor and the outer rotor, wherein at least one tooth crest is retracted to form a large clearance, the large clearance being greater than the tip clearance, taking the number of teeth of at least one of said inner rotor and said outer rotor as n, large clearances are arranged in one of a uniform and a non-uniform fashion on appropriate tooth crests of said teeth, and the number of teeth, n, of said inner rotor is set to an odd number, and said large clearance is provided one of at least every other tooth position and every other two tooth positions, on ((n−1)/2) tooth crests.

* * * * *